US010109913B2

(12) United States Patent
Kohn et al.

(10) Patent No.: US 10,109,913 B2
(45) Date of Patent: Oct. 23, 2018

(54) ANTENNA SUPPORT TO BE MOUNTED ON AN ELECTRICAL BOARD

(71) Applicant: SAGEMCOM BROADBAND SAS, Rueil Malmaison (FR)

(72) Inventors: Stephane Kohn, Rueil Malmaison (FR); Romain Dejardin, Rueil Malmaison (FR)

(73) Assignee: SAGEMCOM BROADBAND SAS, Rueil Malmaison (FR)

( * ) Notice: Subject to any disclaimer, the term of this patent is extended or adjusted under 35 U.S.C. 154(b) by 35 days.

(21) Appl. No.: 15/302,355

(22) PCT Filed: Apr. 17, 2015

(86) PCT No.: PCT/EP2015/058450
§ 371 (c)(1),
(2) Date: Oct. 6, 2016

(87) PCT Pub. No.: WO2015/162071
PCT Pub. Date: Oct. 29, 2015

(65) Prior Publication Data

US 2017/0033452 A1 Feb. 2, 2017

(30) Foreign Application Priority Data

Apr. 24, 2014 (FR) ..... 14 53714

(51) Int. Cl.
*H01Q 1/38* (2006.01)
*H01Q 1/12* (2006.01)
*H01Q 1/22* (2006.01)
*H01Q 9/04* (2006.01)
*H01Q 9/40* (2006.01)

(52) U.S. Cl.
CPC ..... *H01Q 1/38* (2013.01); *H01Q 1/12* (2013.01); *H01Q 1/2291* (2013.01); *H01Q 9/0407* (2013.01); *H01Q 9/40* (2013.01)

(58) Field of Classification Search
CPC ..... H01Q 1/38; H01Q 1/12; H01Q 1/2291
See application file for complete search history.

(56) References Cited

U.S. PATENT DOCUMENTS 6,448,932 B1 9/2002 Stoiljkovic et al.
2009/0015511 A1 1/2009 Chang et al.
2011/0298669 A1 12/2011 Rao et al.

*Primary Examiner* — Graham Smith
(74) *Attorney, Agent, or Firm* — Muncy, Geissler, Olds & Lowe, P.C.

(57) ABSTRACT

An antenna support to be mounted on an electrical board and used to carry an antenna which is electrically connected to the board. The support has a plurality of housings, each one suitable for receiving the antenna according to different orientations; device for adjusting the position of the antenna on the board; and device for fixing the support to the board. An electrical board provided with an antenna support, a method for positioning an antenna to be connected to an electrical board, and a method for producing an electrical board connected to an antenna are also provided.

12 Claims, 3 Drawing Sheets

ANTENNA SUPPORT TO BE MOUNTED ON AN ELECTRICAL BOARD

The invention relates to the field of transmitting information wirelessly, and it seeks more particularly to provide: an antenna support; an electric circuit card provided with such a support; a method of placing an antenna; and a method of fabricating an electric circuit card fitted with an antenna.

BACKGROUND OF THE INVENTION

A home electronic appliance, such as an Internet gateway of the set-top-box or ADSL box type conventionally comprises a casing incorporating at least one electric circuit card and an antenna that is connected to the electric circuit card to enable the electronic appliance to exchange data with other electronic appliances (e.g. belonging to the same WiFi type wireless network).

The placing of the antenna on the card or in the casing is generally defined during a design stage preceding the design of the printed circuit of the card, with said prior design stage also involving stages of designing the electrical circuit for the card, performing radio simulations, modeling, testing, etc.

The placing of the antenna is thus already frozen at the time the printed circuit is designed and fabricated, the electronic components are soldered on the card, and the card is incorporated together with the antenna in the casing. Unfortunately, it can happen that the operation of the system formed by the card and the antenna differs from what was expected, e.g. because of interference being underestimated between the antenna in question and another antenna on the card, or as a result of a late mechanical modification to the casing having an influence on the radiation pattern of the antenna, etc. When such a phenomenon requires the placing of the antenna to be modified, it is necessary to design and fabricate a new printed circuit, which tends to increase the cost of developing an electronic appliance.

OBJECT OF THE INVENTION

An object of the invention is to reduce the cost of developing an electronic appliance including an electric circuit card connected to an antenna.

SUMMARY OF THE INVENTION

In order to achieve this object, the invention provides an antenna support for mounting on an electric circuit card and for carrying an antenna that is electrically connected to the card, the support comprising:

- a plurality of housings, each adapted to receive the antenna in a distinct orientation;
- adjustment means for adjusting the position of the antenna on the card;
- means for fastening the support on the card.

Thus, the orientation of the antenna and the position of the antenna on the card are not already frozen at the time the printed circuit of the card is designed and fabricated. If the operation of the system formed by the card and the antenna differs from the expected operation, then the antenna support of the invention makes it possible to modify the orientation of the antenna by installing it in another housing, or to modify the position of the antenna on the card by using the means for adjusting the support.

The invention also provides an electric circuit card provided with an antenna support as described above, said antenna support being adapted to carry an antenna that is electrically connected to the electric circuit card.

The invention also provides a method of placing an antenna that is for connection to an electric circuit card, the method comprising the steps of:

- installing the antenna in a housing of an antenna support as described above;
- mounting the support on the card;
- taking a radio measurement in order to evaluate a parameter that is representative of the quality of the placing of the antenna;
- modifying the orientation of the antenna and/or the position of the support in order to improve said parameter.

Finally, the invention provides a method of fabricating an electric circuit card connected to an antenna, the method comprising the steps of:

- fabricating a printed circuit card;
- mounting the electronic components of the card on the printed circuit;
- placing the antenna by using the placing method according to the preceding claim;
- fastening the support to the card.

The invention can be better understood in the light of the following description of a particular, non-limiting embodiment of the invention.

BRIEF DESCRIPTION OF THE DRAWINGS

Reference is made to the accompanying drawings, in which.

DETAILED DESCRIPTION OF THE INVENTION

Figure 1:
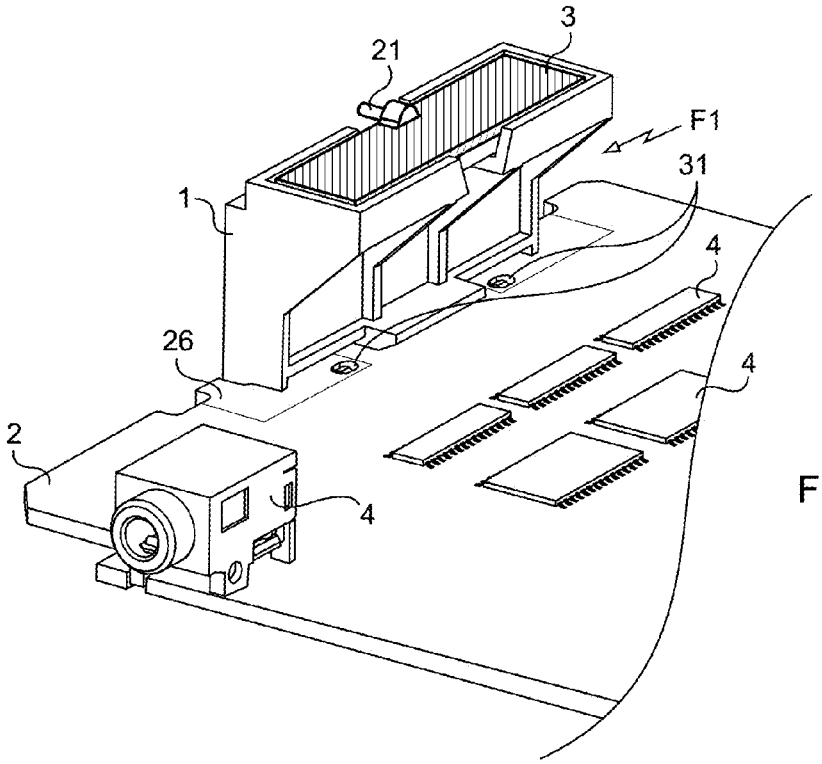
FIG. 1 shows an electric circuit card and the antenna support of the invention mounted on said electric circuit card.
Figure 2:
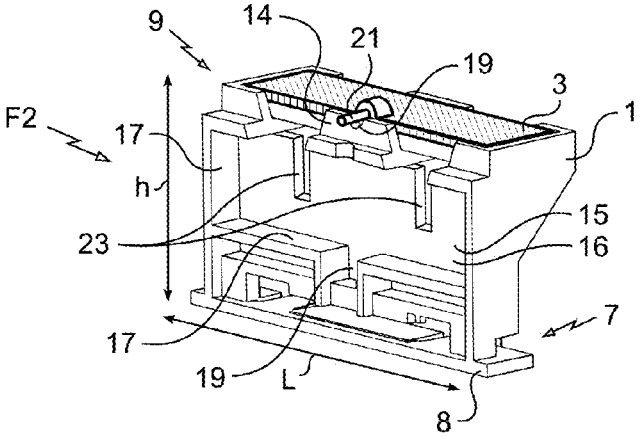
FIG. 2 is a rear view in perspective of the antenna support of the invention receiving a flat-plate antenna parallel to the electric circuit card.
Figure 3:
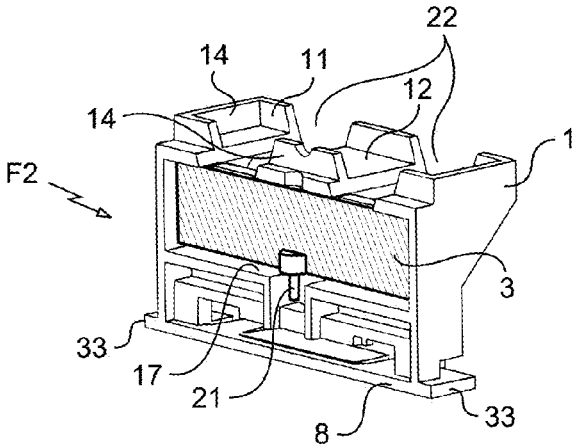
FIG. 3 is a view analogous to the view of FIG. 2, in which the flat-plate antenna is received perpendicularly to the card.
Figure 4:
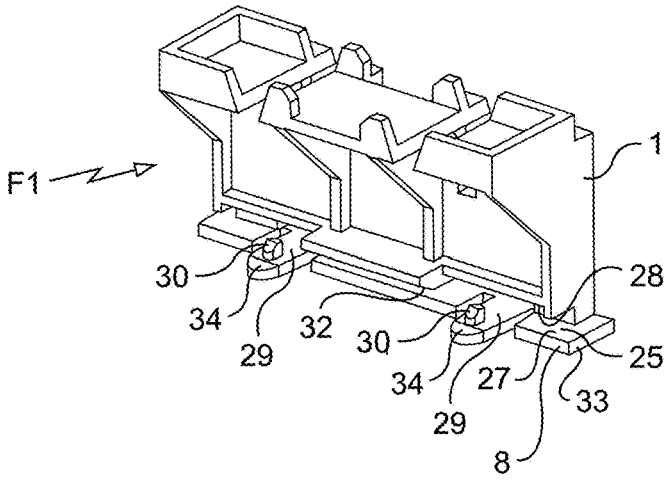
FIG. 4 is a front perspective view of the antenna support of the invention, said support not carrying an antenna.
Figure 5:
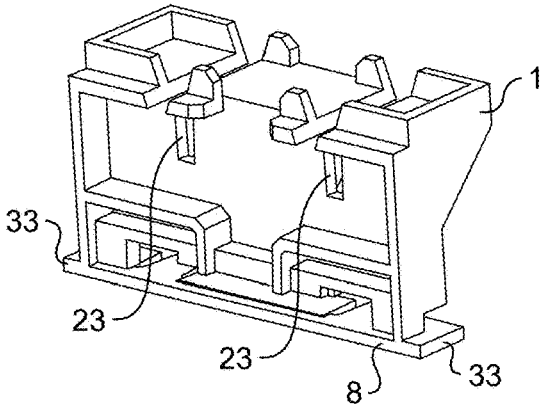
FIG. 5 is a rear perspective view analogous to the view of FIG. 4.

With reference to FIGS. 1 to 6, the antenna support 1 of the invention is for mounting on an electric circuit card 2 and for carrying an antenna 3 that is electrically connected to the electric circuit card 2. The antenna 3 in this example is a flat-plate antenna as used for transmitting data using a WiFi protocol. The electric circuit card 2 and the antenna 3 are incorporated in a casing 10 (visible in FIG. 6) of a home electronic appliance of the set-top-box type. The electric circuit card 2 is itself constituted by a printed circuit having some number of various electronic components 4 soldered thereto, including a data processor connected to radio frequency components (transceiver, etc.) that are directly connected to the antenna 3.

The antenna support 1 extends over a length L and over a height h that is less than the length L. A front face F1 of the antenna support 1 is defined that extends facing the electric circuit card 2 when the antenna support 1 is mounted on the electric circuit card 2, and a rear face F2 of the antenna support 1 is defined that extends facing a side face of the casing 10 when the electric circuit card 2 and the antenna support 1 are incorporated in the casing 10.

The antenna support 1 presents a bottom portion 7 having a substantially plane bottom face 8 of generally rectangular shape that is to bear against the electric circuit card 2, and a top portion 9 cantilevered out over the electric circuit card 2 and defining a first housing 11 for receiving the antenna 3 so that it extends parallel to the electric circuit card 2.

The first housing 11 has a first flat bottom wall 12 parallel to the bottom base 8. The first bottom wall 12 is generally rectangular in shape and of area greater than the area of the bottom base 8, and it is surrounded by first rims 14 projecting perpendicularly from the first bottom wall 12.

The antenna support 1 has a second housing 15 for receiving the antenna 3 in such a manner that it extends perpendicularly to the electric circuit card 2. The second housing 15 extends over the rear face F2 of the antenna support 1 and is defined in an intermediate portion of the antenna support 1 connecting together the top portion 9 and the bottom portion 7. Like the first housing 11, the second housing 15 has a second flat bottom wall 16 of shape that is generally rectangular and of area S, extending perpendicularly to the first bottom wall 12. The second bottom wall 16 is surrounded by second rims 17 projecting perpendicularly from the second bottom wall 16.

Each of the first and second housings 11 and 15 is adapted to receive the antenna 3 in a distinct orientation. In this example, the first housing 11 is adapted to receive the antenna 3 parallel to the electric circuit card 2, while the second housing 15 is adapted to receive the antenna 3 perpendicularly to the electric circuit card 2.

Each of the first and second housings 11 and 15 is provided with a respective notch 19, said notches 19 being formed respectively in a first rim 14 situated in the vicinity of the rear face F2 of the antenna support 1 and in a second rim 17. These notches 19 are for guiding an electric wire 21 connecting the antenna 3 of the electric circuit card 2. These notches 19 make it possible to control very accurately the length, the position, and the stiffness of the electric wire 21.

Each of the first and second housings 11 and 15 has keying means for preventing the electric circuit card 2 fitted with the antenna support 1 and an antenna 3 installed in a wrong housing of the support 1 from being mounted in the casing 10. In this example, the keying means comprise two first slots 22 situated in the first bottom wall 12 of the first housing 11 and two second slots 23 situated in the second bottom wall 16 of the second housing 15. The first slots 22 are perpendicular to the second slots 23, which extend in continuity with the first slots 22. The first and second slots 22 and 23 are designed to co-operate with complementary tongues 24 of the casing 10. When the antenna 3 of the electronic appliance is supposed to be mounted in the first housing 11, the tongues 24 of the casing 10 are positioned on a side face of the casing 10 so that they are inserted into the second slots 23 when the electric circuit card 2 and the antenna support 1 are incorporated in the casing 10. This situation corresponds to the tongues 24 shown in continuous lines in FIG. 6. Thus, when an operator incorporates the electric circuit card 2 with the antenna 3 in the casing 10, if the antenna 3 is wrongly positioned in the second housing 15 instead of in the first housing 11, then the tongues engage the antenna 3, thereby preventing assembly and warning the operator that the antenna is not mounted in the correct housing. Likewise, when the antenna 3 of the electronic appliance is supposed to be mounted in the second housing 15, the tongues 24 of the casing are positioned on the lid of the casing 10 so that they become inserted into the first slots 22 when the electric circuit card 2 and the antenna support 1 are incorporated in the casing 10. This situation corresponds to the tongues 24 drawn in dashed lines in FIG. 6. Thus, if the antenna 3 is wrongly positioned in the first housing 11, then at the time of incorporation the tongues will engage the antenna 3 and prevent the lid of the casing 10 being put into place properly.

The antenna support 1 also has means for adjusting the position of the antenna 3 on the electric circuit card 2, which means are situated in the bottom portion 7 of the antenna support 1. The term "position of the antenna" is used herein to mean the position of the antenna along an edge 26 of the electric circuit card 2, independently of the orientation of the antenna. These adjustment means comprise a slideway 25 co-operating with the edge 26 of the electric circuit card 2 when the antenna support 1 is mounted on the card 2. The slideway 25 has a bearing plane 27, specifically formed by a top face of the base 8 of the antenna support 1, and a plane counter bearing face 28. The slideway 25 enables the position of the antenna support 1 to be modified while it is being mounted on the electric circuit card 2 by causing the antenna support 1 to slide along the edge 26, thus enabling the position of the antenna support 1 to be modified. The plane of the counter bearing face 28 has a first chamfer 32 for facilitating insertion of the edge 26 of the electric circuit card 2 in the slideway 25 when mounting the antenna support 1 on the electric circuit card 2.

The antenna support 1 also has means for fastening the antenna support 1 on the electric circuit card 2 enabling the antenna support 1 to be fastened once its position along the edge 26 of the electric circuit card 2 is defined. The fastening means comprise two flexible tabs 29, each provided with a fastener peg 30 that extends in line with the plane bearing face 27 of the slideway 25. A position for fastening the antenna support 1 is defined on the electric circuit card 2 by fastening orifices 31 formed for this purpose in the electric circuit card 2. It should be observed that each flexible tab 29 has a second chamber 34 for facilitating insertion of the edge 26 of the electric circuit card 2 in the slideway 25.

When the antenna support 1 is mounted on the electric circuit card 2 and is not yet in a fastening position, the flexible tabs 29 are inclined by the action of the electric circuit card 2 on the fastener pegs 30 of the flexible tabs 29, thereby enabling the antenna support 1 to be slid along the edge 26 of the electric circuit card 2. When the antenna support 1 is located on the card 2 in a fastening position, the fastener pegs 30 are received in the fastener orifices 31, thereby enabling the antenna support 1 to be fastened on the electric circuit card 2.

It should be observed that the antenna support 1 has two protuberances 33 situated extending the base of the antenna support 1. These protuberances 33 enable the antenna support 1 to be fastened on an element that might be different from an electric circuit card, e.g. on a mechanical element situated in the bottom of the casing 10 and provided for this purpose. In order to fasten the antenna support 1, the protuberances 33 co-operate by way of example with slideways or with a clip fastener system or they may receive screws.

Figure 7:
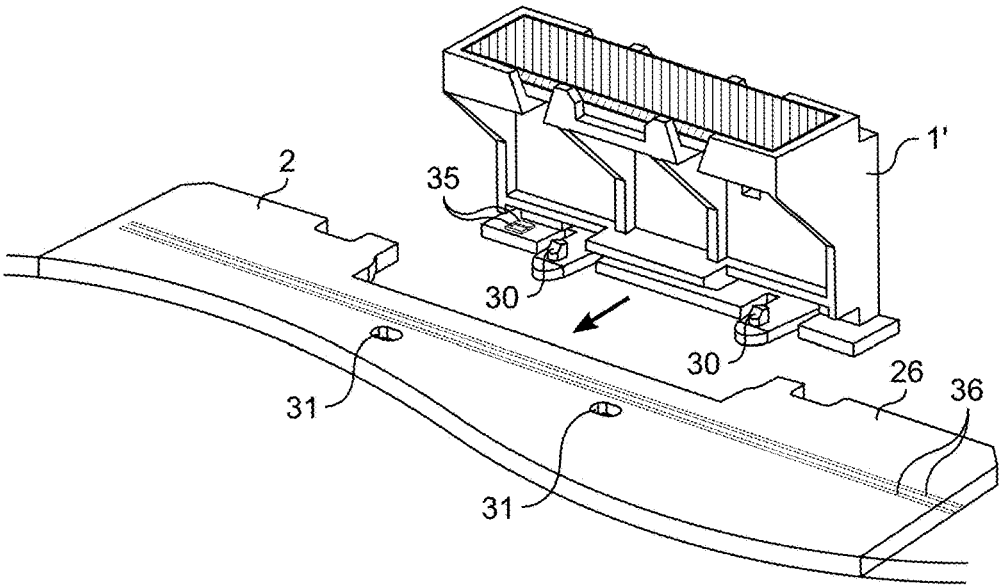
FIG. 7 shows an antenna support of the invention in a second embodiment having conductive pads coming into contact with tracks on the card in order to connect the antenna electrically in the card.
Figure 6:
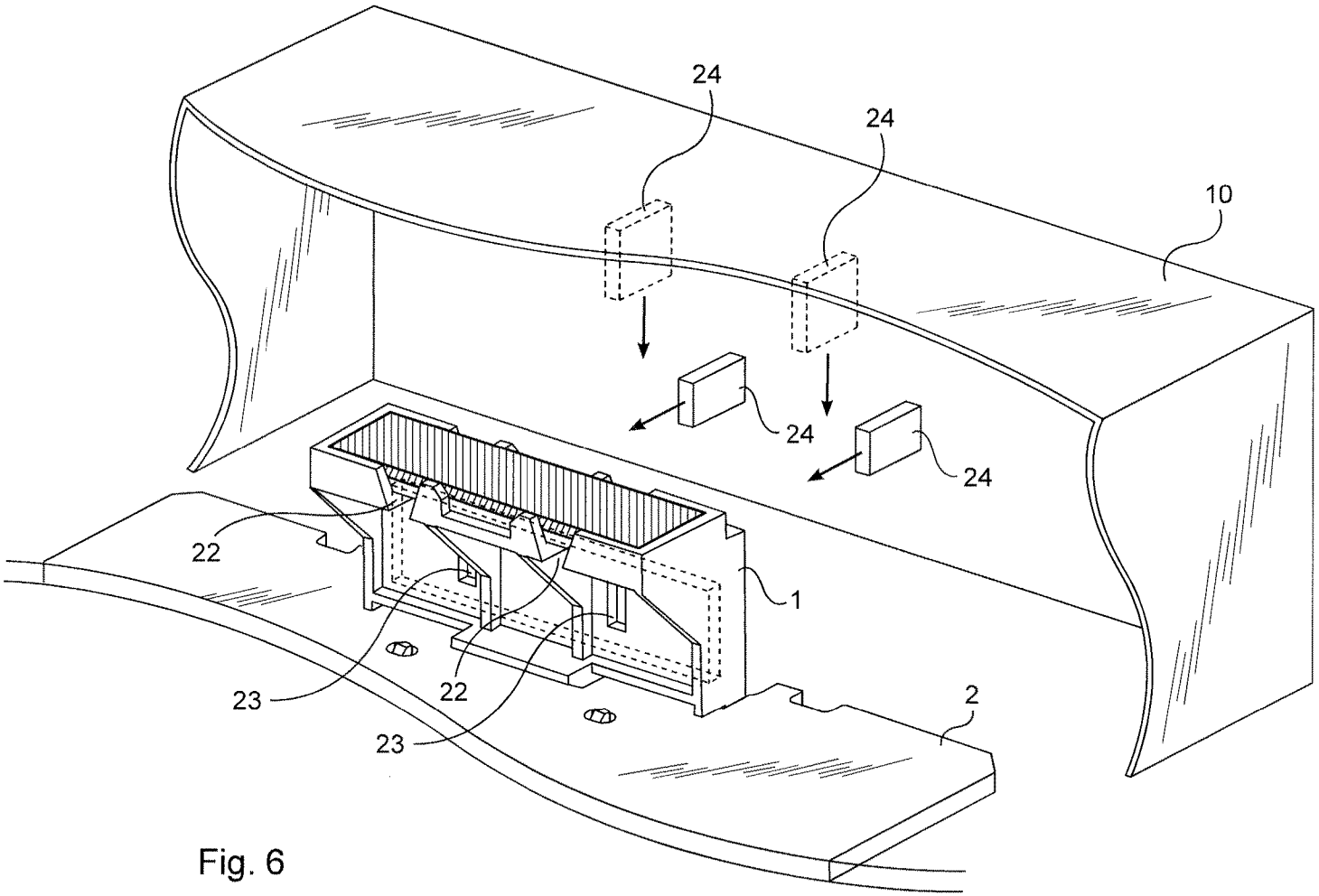
FIG. 6 is a cutaway view showing the electric circuit card fitted with the antenna support of the invention and a casing in which the card is incorporated.

In a second embodiment, shown in FIG. 7, the base 8 of the antenna support 1' is provided in the plane bearing surface 27 with two first conductor elements 35 that are electrically connected to the antenna 3, specifically two conductor pads 35, and the printed circuit of the electric circuit card 2 has two second conductor elements 36, specifically two parallel tracks 36 that are not varnished and that run along the edge 26 of the card 2. When the antenna support 1' is mounted on the electric circuit card 2, the pads 35 and the parallel tracks 36 thus come into contact and the antenna 3 is thus electrically connected to the electric circuit card 2. It is thus possible to modify the position of the antenna support 1', and even to slide the antenna support 1', while maintaining this electrical connection (providing the pads 35 remain in contact with the tracks 36).

There follows a description in greater detail of certain advantageous uses of the antenna support of the invention.

The antenna support 1, 1' is particularly well adapted to defining the placing of an antenna 3 that is to be connected to an electric circuit card 2. The term "placing" is used herein to cover both the orientation of the antenna 3 and the position of the antenna 3 on the card 2, with the term "position" being understood as defined above.

The method of placing an antenna 3 of the invention begins with a step of installing the antenna 3 in a housing 11, 15 of the antenna support 1, 1' that is adapted to receive the antenna 3 in a preferred orientation, which preferred orientation may be defined by way of example as a result of a prior design stage.

Thereafter, the placing method comprises a step of mounting the antenna support 1, 1' on the electric circuit card 2 at a certain position along the edge 26 of the electric circuit card 2.

Thereafter, the placing method comprises a step of taking radio measurements in order to evaluate a parameter representative of the quality with which the antenna 3 is placed. By way of example, such radio measurements consist in measuring an electric field at a certain frequency in order to evaluate the transmission quality of the antenna 3 at this particular frequency.

The placing method then finally includes a step of modifying the position of the antenna support 1, 1' on the edge 26 of the electric circuit card 2 in order to improve the parameter in question so that the system formed by the electric circuit card 2 and the antenna 3 operates in satisfactory manner. Optionally, the orientation of the antenna 3 may be modified by installing it in the other housing 11, 15 in order to improve said parameter.

The placing method of the invention may be used during a test stage prior to designing the printed circuit of the electric circuit card, so as to define the final placing of the antenna relative to the card.

The placing method of the invention may also be used during the method of fabricating an electric circuit card 2 of the invention. The fabrication method consists in making provision to freeze the position of the antenna 3 after the printed circuit of the electric circuit card 2 has been fabricated. The placing method of the invention thus begins with the steps of fabricating the printed circuit and mounting the electronic components 4 of the electric circuit card 2 on the printed circuit. The placing method then includes a step of placing the antenna 3 while using the placing method of the preceding claim. Once the best placing for the antenna 3 has been defined, the antenna support 1, 1' is fastened to the electric circuit card 2 by making orifices 31 in the electric circuit card 2 in order to receive the fastener pegs 30 of the flexible tabs 29 of the antenna support 1.

It should be observed that these orifices 31 in this example are situated outside the boundary plane of the printed circuit of the electric circuit card 2. Drilling these orifices 31 therefore does not damage the printed circuit and does not require additional qualification testing to be performed on the printed circuit.

The invention is not limited to the particular embodiments described above, but on the contrary covers any variant coming within the ambit of the invention as defined by the claims.

Although the antenna support as described has two housings, each adapted to receive the antenna, the invention applies to supports having some other number of housings. Likewise, provision may be made for a different number of flexible tabs, of conductor elements, of keying slots, of fastening positions, etc. The keying slots are optional.

The invention also applies to an antenna of some other shape, when used in radio communication of any type (protocol, frequency, etc.).

It should be observed that although the means for adjusting the position of the antenna on the card as described herein comprise a slideway enabling the position of the support and thus of the antenna on the card to be modified, the means for adjusting the position of the antenna could equally well be situated directly on the support. For example, the support could be provided with a device of the movable drawer type carried by the bottom portion of the support and receiving the antenna. In such a configuration, the support could then be mounted stationary relative to the electric circuit card, with the position of the antenna being modified by sliding the movable drawer on the support.

The invention claimed is:

1. An antenna support for mounting on an electric circuit card and for carrying an antenna that is electrically connected to the card, the support comprising:

a plurality of housings, each adapted to receive the antenna in a distinct orientation;

an adjustable holder for adjusting the position of the antenna on the card;

at least one flexible tab fastening the support on the card.

2. The antenna support according to claim 1, wherein the adjustable holder comprises a slideway co-operating with an edge of the card when the support is mounted on the card, said slideway enabling the position of the support and thus the position of the antenna on the card to be modified by causing the support to slide along the edge.

3. The antenna support according to claim 2, wherein the at least one flexible tab is provided with a fastener peg and extends in line with a plane bearing face of the slideway, said at least one flexible tab bending under the action of the card on the peg while the support is being mounted on the card without being in a fastening position for the support on the card, said fastener peg being received in an orifice formed for this purpose in the card when the support is to be found in a fastening position on the card.

4. The antenna support according to claim 3, wherein the orifice is situated outside a boundary plane of a printed circuit of the electric circuit card.

5. The antenna support according to claim 1 adapted to carry a flat-plate antenna, said support including a first housing adapted to receive an antenna parallel to the card and a second housing adapted to receive the antenna perpendicularly to the card.

6. The antenna support according to claim 5, wherein at least one of the housings includes at least one slot for preventing the card fitted with the support and with an antenna installed in a wrong housing from being mounted in a casing.

7. The antenna support according to claim 6, wherein the at least one slot is situated in a bottom wall of the housing.

8. The antenna support according to claim 1, wherein at least one of the housings is provided with a notch for guiding an electric wire connecting the antenna to the card.

9. The antenna support according to claim 1, wherein the support includes at one least first conductor element for coming into contact with a second conductor element situated on the card when the support is mounted on the card in such a manner as to connect the card electrically to the support.

10. An electric circuit card provided with an antenna support according to claim 1, said antenna support being adapted to carry an antenna that is electrically connected to the electric circuit card.

11. A method of placing an antenna that is for connection to an electric circuit card, the method comprising the steps of:

installing the antenna in a housing of an antenna support according to claim 1;

mounting the support on the card;

taking a radio measurement in order to evaluate a parameter that is representative of the quality of the placing of the antenna;

modifying the orientation of the antenna and/or the position of the support in order to improve said parameter.

12. A method of fabricating an electric circuit card connected to an antenna, the method comprising the steps of:

fabricating a printed circuit card;

mounting the electronic components of the card on the printed circuit;

placing the antenna by using the placing method according to claim 11;

fastening the support to the card.

* * * * *